US006328528B1

(12) United States Patent
Dahlheimer

(10) Patent No.: US 6,328,528 B1
(45) Date of Patent: Dec. 11, 2001

(54) ELASTOMERIC PUMP IMPELLER

(75) Inventor: John C. Dahlheimer, Laconia, NH (US)

(73) Assignee: Freudenberg-Nok General Partnership, Plymouth, MI (US)

( * ) Notice: Subject to any disclaimer, the term of this patent is extended or adjusted under 35 U.S.C. 154(b) by 0 days.

(21) Appl. No.: 09/558,010

(22) Filed: Apr. 25, 2000

(51) Int. Cl.[7] ..... F04D 29/08

(52) U.S. Cl. ..... 415/113; 415/111; 415/141; 415/174.2; 415/174.3; 277/370; 277/376; 277/390; 277/423

(58) Field of Search ..... 415/111, 113, 415/140, 141, 170.1, 174.2, 174.3, 230, 231; 277/370, 376, 390, 423

(56) References Cited

U.S. PATENT DOCUMENTS

| | | | | |
|---|---|---|---|---|
| 3,663,026 | * | 5/1972 | Mincuzzi | 277/423 |
| 3,846,045 | | 11/1974 | Mincuzzi . | |
| 3,914,072 | * | 10/1975 | Rowley et al. | 415/174.2 |
| 4,411,593 | * | 10/1983 | Taguchi | 415/174.2 |
| 4,502,697 | | 3/1985 | Heinl . | |
| 4,925,366 | | 5/1990 | Dorski . | |
| 4,944,653 | * | 7/1990 | Wilkes | 415/170.1 |
| 6,062,815 | | 5/2000 | Holt et al. . | |
| 6,113,106 | * | 9/2000 | Dahlheimer | 277/423 |

FOREIGN PATENT DOCUMENTS

| | | | | |
|---|---|---|---|---|
| 3636165-C1 | * | 6/1987 | (DE) | 415/230 |

* cited by examiner

*Primary Examiner*—Christopher Verdier
(74) *Attorney, Agent, or Firm*—A. Michael Tucker; Casimir R. Kiczek

(57) ABSTRACT

A water pump with a plurality of elastomeric blades on a rigid impeller is disclosed. The impeller has a tubular extension with a pair of flats on the outer diameter of the extension. The seal seat has a corresponding pair of flats on its inner diameter to engage the flats on the tubular extension for positive rotation. The impeller also has a retaining lip formed on its inner diameter and a sealing shoulder to form a retaining cavity along the tubular extension. The retaining lip receives the seal seat in the cavity by stretching the lip radially into a gap to accommodate the outer diameter of the seal seat. This stretch to fit feature eliminates the need to control the outer diameter of the seal ring to precise dimensions. The lip forms a static seal with the outer diameter of the seal seat. The elastomeric shoulder provides a static seal against the seal seat.

20 Claims, 4 Drawing Sheets

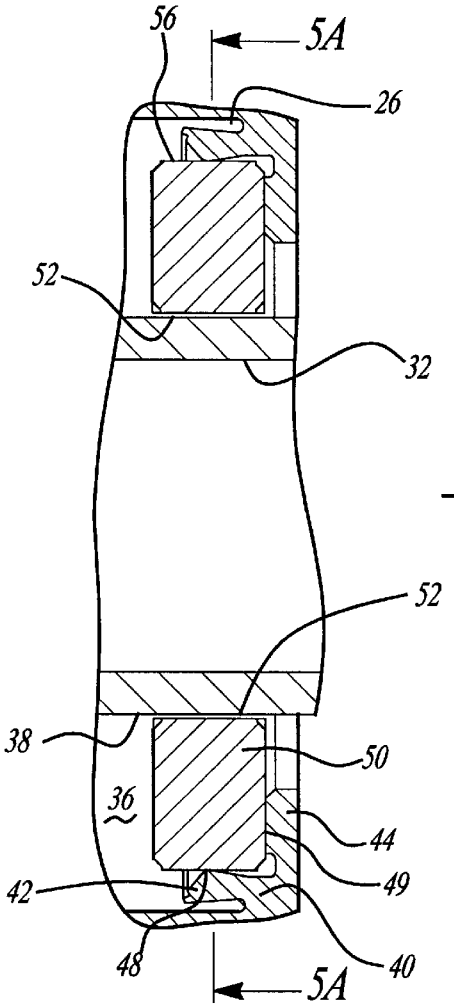
Fig-5
Fig-5a
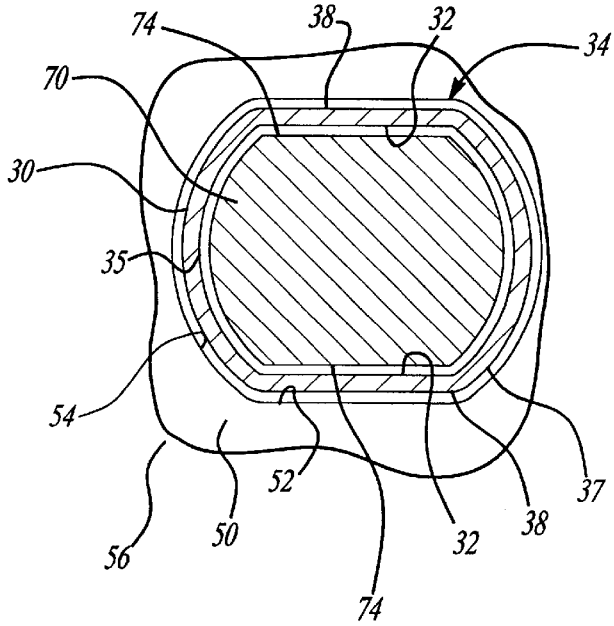

ELASTOMERIC PUMP IMPELLER

BACKGROUND OF THE INVENTION

This invention generally relates to pumps with impellers and in particular to an elastomeric water pump impeller used in appliances.

Dishwashers and washing machines use water pumps with impellers to move liquid through and out of the appliance in a series of wash, rinse, and drain cycles. Such pumps include a housing, a rigid cover, an elastomeric impeller molded around a rigid impeller insert for slip fitting onto a rotatable drive shaft or motor shaft, a mechanical face seal consisting of a seal head assembly and a seal seat for preventing liquid leakage between the fixed housing and the rotating impeller, and a two-piece thrust bearing, one half mounted in the impeller for running against the other half mounted in the rigid cover. This thrust bearing resists the axial force of the mechanical face seal and also establishes the axial running clearances of the impeller with both the housing and the rigid cover as well as determining the axial operating height of the mechanical face seal assembly.

Conventional water pumps rely on a controlled cross-sectional squeeze of a fixed integral elastomeric radial rind molded into the inner diameter of the rigid impeller insert to provide retaining, static sealing, and positive rotational drive functions between the inner diameter of the impeller insert and the seal seat outer diameter. Additionally, this cross-sectional squeeze requirement is very precise which often necessitates centerless grinding of the seal seat's outer diameter. However, this system is complex and costly. Thus, there is a need for a simpler, more cost effective and reliable water pump for appliances that is easier to fabricate and faster to assemble.

SUMMARY OF THE INVENTION

The present invention provides an impeller with a seal seat retainer for a water pump having a rigid insert. The elastomeric impeller is attached to the rigid insert which has a tubular extension. The elastomeric impeller has a radial elastomeric retaining lip on its inner diameter and a portion forming a receiving cavity between the lip and the tubular extension. The seal seat is disposed in the receiving cavity. The elastomeric lip is stretched radially to permit receiving the seal seat in the receiving cavity and subsequently, as the lip contracts radially to its original condition, the lip grips the seal seat in the receiving cavity. This results in a simpler, more cost effective water pump impeller and seal seat assembly.

The object of the present invention is to provide a water pump with an elastomeric impeller with an integral, axially extending and radial retaining elastomeric lip which initially stretches radially outward to receive a seal seat with a wide range of outer diameter tolerances therein and which subsequently attempts to return to an unstretched condition, providing a compressive force on the outer diameter of the seal seat to hold it in a receiving cavity with respect to the impeller.

Another object of the present invention is to provide a radial retaining lip to capture the seal seat outer diameter during assembly and to provide for a static sealing shoulder between the seal seat and the rigid insert of the elastomeric impeller.

Still another object is to provide an elastomeric impeller with a rigid insert that includes flats located on an outer diameter of the rigid insert to engage flats located on the inside diameter of the seal seat in order to provide a positive rotational drive member between the impeller and the seal seat.

A still further object of the invention is to provide an elastomeric bladed pump impeller with a positive drive to the seal seat and which optionally can be provided with a formed open channel in the axially extending and radial retaining elastomeric lip to permit detection of any leakage between the integral elastomeric annular sealing shoulder surface and the rear surface of the seal seat.

Yet another object of the invention is to provide an elastomeric radial retaining lip on an inner diameter of the impeller which captures the seal seat therein and which forms a static seal between the seal seat outer diameter and an inner diameter of the impeller and which provides a secondary rotational drive with the seal seat.

These and other objects and features of the present invention will become apparent from the description and especially taken in conjunction with the accompanying drawings illustrating the invention and the preferred embodiment.

BRIEF DESCRIPTION OF THE DRAWINGS

The various advantages of the present invention will become apparent to one skilled in the art upon reading the following specification and by reference to the drawings which include:

FIG. 5 is a cross-sectional view of the seal seat rotated 90° from FIG. 4, showing the seal seat installed in the retention cavity;

FIG. 5*a* is a cross-sectional view along section 5*a*–5*a* of the elastomeric impeller's tubular extension and shaft of FIG. 5;

DETAILED DESCRIPTION OF THE PREFERRED EMBODIMENT

Figure 1:
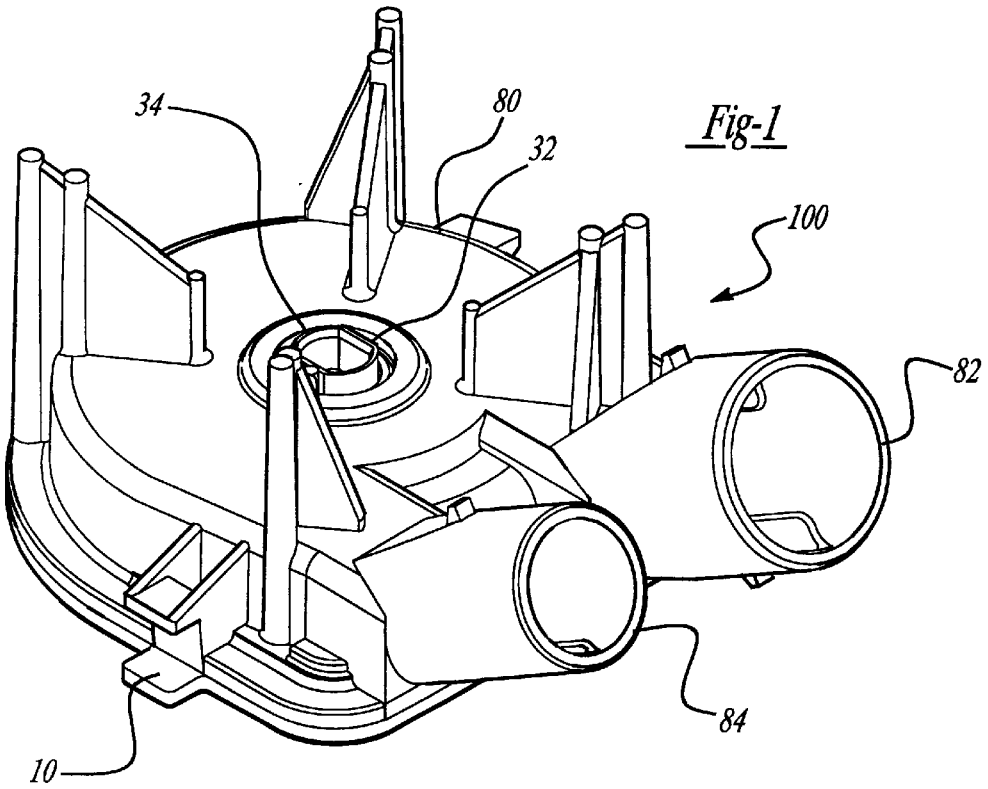
FIG. 1 is a perspective view of the water pump fitted with the impeller and seal seat according to the invention.
Figure 2:
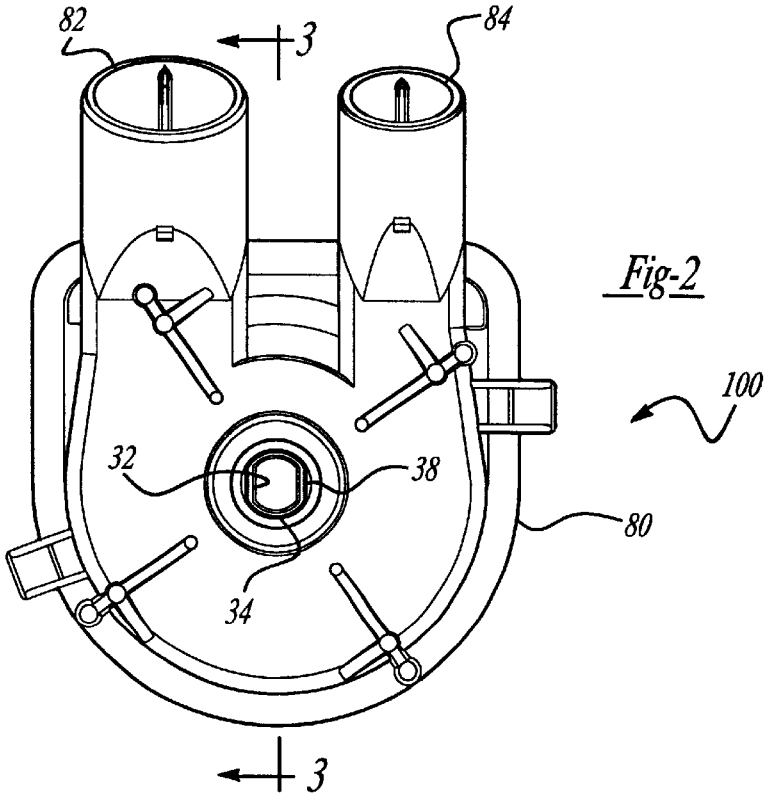
FIG. 2 is a frontal view of the water pump fitted with the impeller and seal seat according to the present invention.
Figure 3:
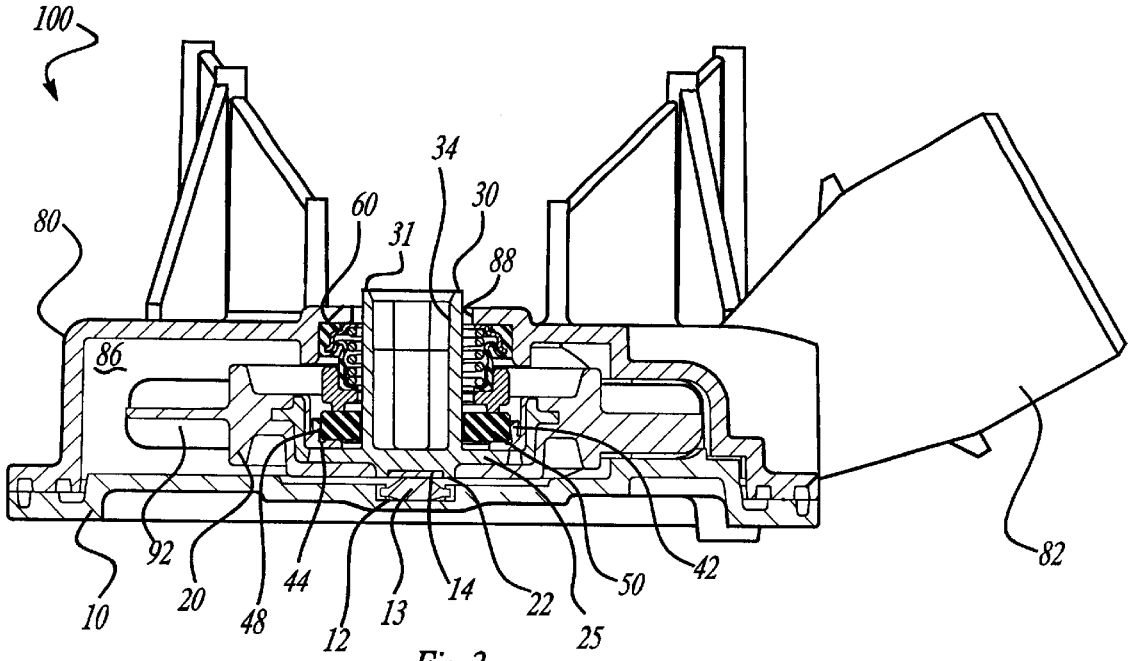
FIG. 3 is a cross-sectional view of the water pump with the elastomeric impeller and seal seat according to the present invention along section 3—3 of FIG. 2.
Figure 4:
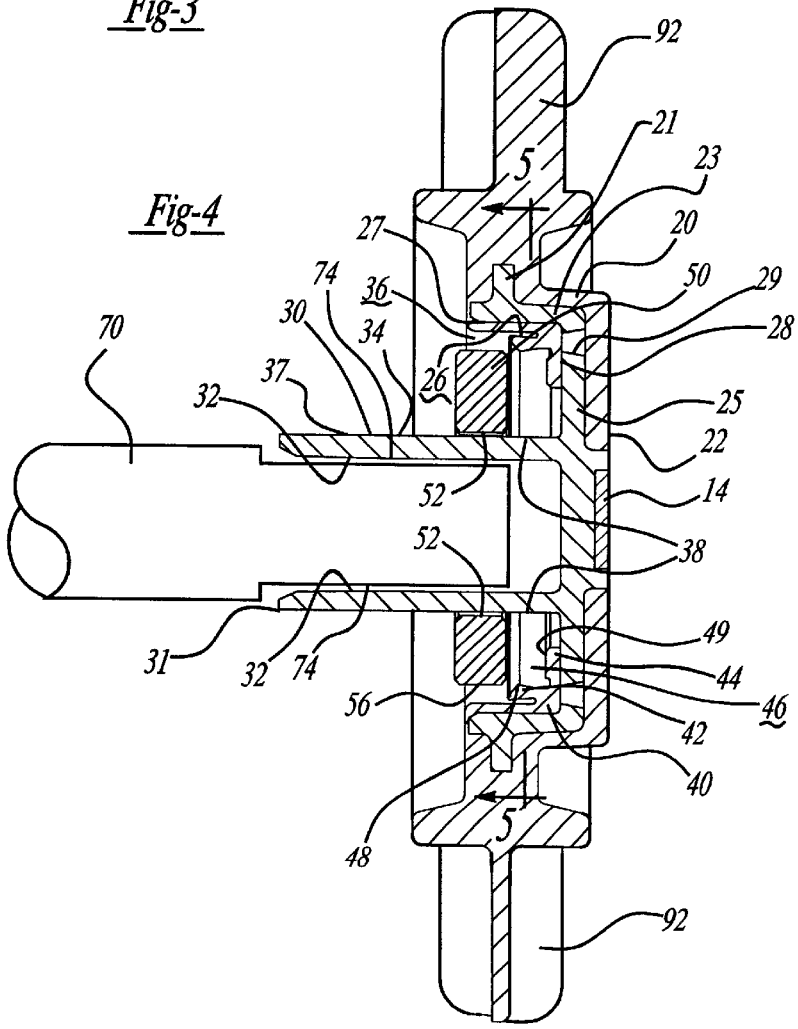
FIG. 4 is a cross-sectional view of the elastomeric impeller prior to installation of the seal seat into the retention cavity.

A water pump fitted with the impeller and seal seat according to the present invention is designated by the numeral 100 as shown in FIGS. 1 through 3. In FIGS. 1 and 2, the water pump 100 has an inlet 82, an outlet 84, a cover 10, a housing 80 and a tubular portion 34 of the impeller (not shown) with a pair of flats 32 on the outer diameter of the tubular portion 34. As shown in FIGS. 3 and 4, the water pump 100 also includes an elastomeric bladed impeller 20, a rigid impeller insert 30 with a tubular extension 34, an elastomeric body 40 with a radial retaining lip 42 and a shoulder 44, an annular seal seat 50 and a seal head or mechanical face seal assembly 60, all of which are disposed in cavity 86 in a housing 80. A two-piece thrust bearing consisting of a graphite phenolic thrust button 13 mounted in a cavity 12 in the cover 10 and a ceramic thrust disk 14 mounted in the face 22 of the impeller 20 establishes the axial running clearance of the face of the impeller 20 with both the housing 80 and the cover 10 and it also determines the axial running height of the mechanical face seal assembly 60 as is conventional.

Figure 7:
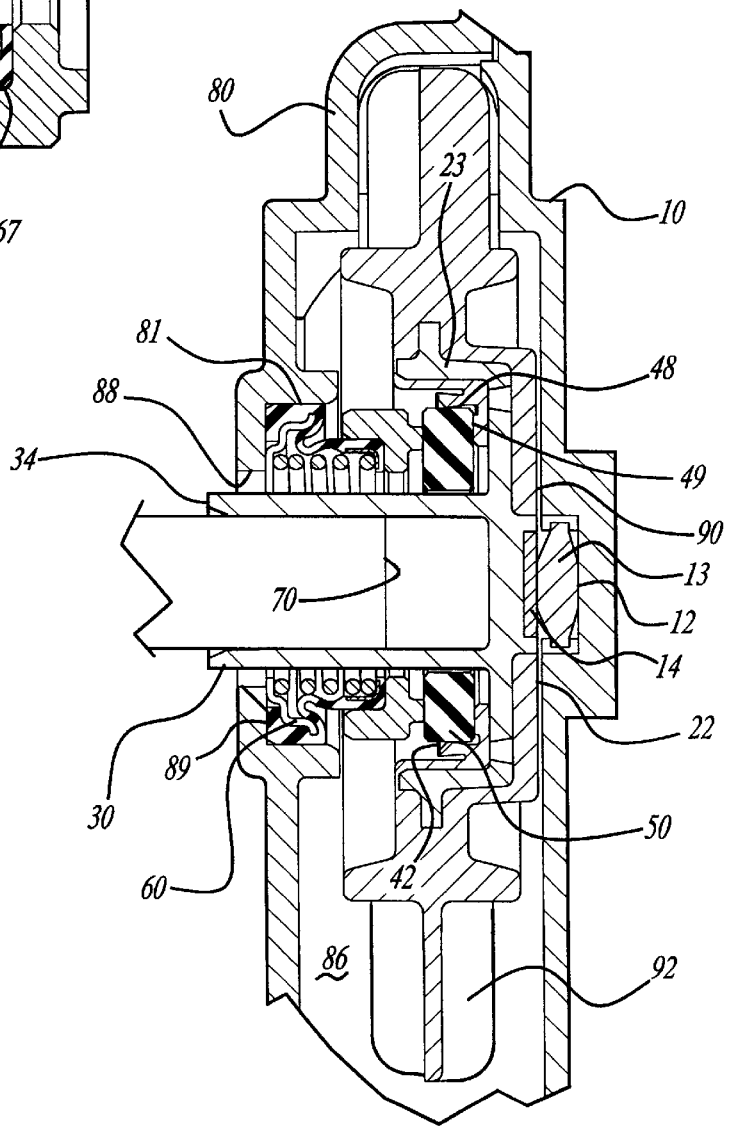
FIG. 7 is a partial cross-sectional view of the water pump assembly with the elastomeric impeller and seal seat according to the invention.

As best shown in FIGS. 3, 4, and 7, the elastomeric blade impeller 20 is molded onto or alternatively, attached by conventional means to a rigid impeller insert 30. The rigid insert 30 may be made of metal such as steel or aluminum or the like or preferably from a glass filled reinforced thermoplastic such as nylon 66 with 30% glass filled fiber. Alternatively, the insert 30 may be made from a glass filled thermoset plastic polymer such as phenolic. The insert 30 has a tubular extension 34 which extends axially from the face 22 of the insert 30 to the projecting end 31. As best shown in FIG. 5*a*, the tubular extension 34 has an inner diameter 35 and an outer diameter 37. The outer diameter 37 has a pair of outer flats 38 and the inner diameter 35 has a pair of inner flats 32. The drive shaft 70 of the motor (not shown) has an outer diameter which slip fits into the inner diameter 35 of the tubular extension 34 and has a pair of opposing flats 74 on drive shaft 70 to engage the inner flats 32 on the tubular extension 34. This permits the rigid insert 30 of the impeller 20 to be directly connected to the motor shaft 70 by the engagement of the flats 32 with the flats 74 and thus, provides positive drive and prevents relative rotation therebetween. A conventional thrust bearing system consisting of a graphite phenolic thrust button 13 inserted into cavity 12 in the cover 10 and a ceramic thrust disk 14 mounted in the face 22 of the impeller insert 30 to set the axial clearance of the face 22 and the cover 10.

The rigid impeller insert 30 has a radially extending portion 25 which is formed adjacent to the face 22. An axially extending section or portion 23 is connected to the radially extending section of portion 25. The axially extending section 23 and the radially extending portion 25 are spaced away from the outer diameter 37 of the tubular extension 34 so as to form an open ended cavity 36. A radially extending portion 21 protrudes radially outward from the section 23 between the junction of section 23 with portion 25 and the free end of axially extending section 23. Near the junction of the section 23 with the portion 25, a plurality of axially extending holes 29 are formed through the radial extending portion 25.

The blades 92 of the impeller 20 are made of elastomeric material which permits the blades 92 to be bonded and molded onto the rigid impeller insert 30. The elastomeric material is also molded and bonded around portions 21, 23, 25, respectively. The elastomeric material is a polymer which is preferably nitrile or, alternatively, it may be hydrogenated nitrile or any other suitable thermoset or thermoplastic elastomeric material. A conventional bonding agent is used to bond the elastomeric material to the insert 30 and to the portions 21, 23, 25, respectively. When the elastomeric material is molded to the rigid impeller insert 30 and while the elastomer is still in a plastic state, the elastomer flows from the face 22 of the insert 30 through the axially extending holes 29 into the cavity 36, and after the vulcanization process, forms an elastomeric body 40. The body 40 extends axially along a portion of the inner diameter 27 of the axially extending section 23 and radially along the inside surface 28 of the radially extending section 25 of the impeller insert 30. An elastomeric sealing shoulder 44 is formed on the portion of the radially extending section 25. An axially extending lip or appendage 42 is formed from the body portion 40 adjacent to but spaced away from the inner diameter 27 of the section 23. The appendage or lip 42 is cantilevered from the elastomeric body 40 so as to form an open ended receiving cavity 46. The lip or appendage 42 is also spaced away from the elastomeric surface portion on the inner diameter 27 by an annulus 26 formed between the elastomeric surface on the inside diameter 27 of section 23 and the lip 42.

The lip or appendage 42 functions to receive the annular seal seat 50 in a receiving cavity 46 in the rubber body 40. The lip 42 is stretched radially outwardly into the annulus 26 of the rubber body 40 to accommodate the considerable outer diameter variations of the seal seat 50. The outer diameter variations of the seal ring 50 can be as much as plus or minus one percent of the diameter. The seal seat 50 is preferably made of ceramic material but alternatively it can be made of carbon, metal, or plastic, or any other suitable material. In forming the seal seat 50, it may be cast, sintered, fired, or molded, as is conventional.

The stretch to fit capability of the radial retaining lip 42 eliminates the need and expense of centerless grinding of the outer diameter 56 of the seal seat 50 to very tight tolerances as is often necessary with conventional elastomeric impeller constructions. Conventional elastomeric impellers rely on the controlled cross-sectional squeeze of a fixed integral elastomer radial rind molded inside a bore of the rigid impeller insert to capture and hold the seal ring. In prior art designs, the radial rind provides retaining, static sealing, and positive rotational drive functions between the impeller insert and the outer diameter of the seal ring.

As best shown in FIGS. 5 and 5*a*, the elastomeric lip 42 forms a static seal 48 along the outer diameter 56 of the seal seat 50. The lip 42 also aids during the assembly process in that the inner diameter of the lip 42 after first being stretched radially to receive the seal seat 50 contracts radially inwardly due to the bias of the elastomer thus gripping the outer diameter 56 of the seal ring 50. This gripping force by the elastomer retains the seal seat 50 within the receiving cavity 46 of the rubber body 40 of the impeller 20 during handling. The gripping force of the elastomer helps to prevent relative rotation of the seal 50 to the lip 42. The elastomeric sealing shoulder 44 on section 25 forms a static seal 49 when the seal seat or ring 50 is inserted into the receiving cavity 46 of the rubber body 40 and is pressed against the shoulder 44 by the preload of the spring 62 of the mechanical face seal 60, as is best shown in FIG. 7. Additionally, during operation, the seal seat 50 is urged by the fluid pressure in the cavity 86 and in the cavity 36 forcing the seal seat 50 against the shoulder 44.

Optionally, passageways (not shown) may be formed in the lip interior surface of the lip 42 to allow detection of any leakage between the shoulder 44 and the seal ring 50 in a manner similar to that described in U.S. Pat. No. 5,676,382, which is owned by the assignee of the present application and is incorporated herein by reference.

Figure 6:
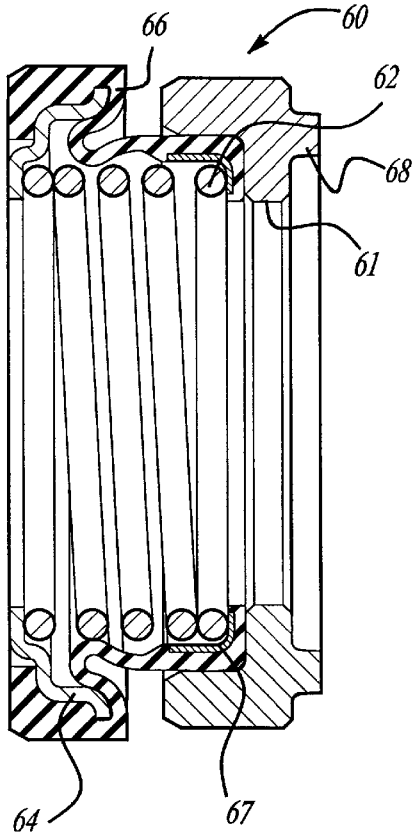
FIG. 6 is a cross-sectional view of the mechanical face seal.

As shown in FIG. 7, the mechanical face seal 60 is disposed around the tubular extension 34 and is positioned axially adjacent to the seal seat 50. The seal 60 abuts against the shoulder 89 of the housing 80 and when compressed axially, is urged against the seal seat 50 as is conventional. Returning to FIG. 6, the seal head assembly 60 also includes an insert 67 to capture the spring 62 adjacent to the seal washer 68, a spring seat 64 and a elastomeric boot 66 which covers the spring seat 64, spring 62, and insert 67. The seal head assembly or mechanical face seal 60 also has a seal washer 68 which is biased by a helical coil compression spring 62 into engagement with the seal seat 50.

The elastomeric boot is preferably made of a polymer such as nitrile rubber but alternately, it may be made of any other elastomeric material suitable for the service conditions of the application such as hydrogenated nitrile, or any suitable thermoplastic polymers. The function of a mechanical face seal head 60 and seal seat 50 is to prevent leakage of fluid in cavity 86 out of the housing 80, as is well known to those skilled in the art.

As shown in FIGS. 4, 5, and 5*a*, the seal seat 50 is rotationally driven by flats 52 on its inside diameter 54 which engage corresponding flats 38 on the outer diameter 37 of the tubular extension 34 of the rigid insert 30. Thus, the seal seat 50 is positively driven rotationally by the mechanical engagement of the flats 52 on the inner diameter 54 of the seal seat 50 with the corresponding flats 38 on the extension 34 of the impeller insert 30. Those skilled in the art will recognize that the number of flats 52 on the seal seat 50 and the corresponding flats 38 of the tubular extension 34 are preferably two but may optionally vary between one and eight. As a result, the present invention does not primarily rely on the elastomeric friction and bias forces between the seal seat 50 and the lip 42 to rotationally drive the seal seat 50 but does so in a secondary capacity until substantial wear occurs between the flats 38, 52, respectively, to permit movement between the flats 38, 52, respectively. Preferably, there is a slight gap between the flats 52 and the flats 38.

As shown in FIG. 7, the pump front cover 10 and pump housing 80 are preferably made of thermoplastic material such as polypropylene, nylon, or polyvinyl chloride or the like so that the cover 10 can be hot plate or ultrasonically welded to the pump housing 80 as is conventional. The seal head assembly 60 is press-fit into the counterbore 81 and against the shoulder 89 of pump housing 80. The seal head 60 has radial clearance between its the inner diameter 61 and the outer diameter 37 of the tubular extension 34 of the impeller 20. When the pump 100 is assembled, the tubular extension 34 of insert 30 is passed through the inner diameter 54 and flats 52 of the seal seat 50 and the interior diameter 61 of seal head assembly 60. Because the axial distance between the seal seat 50 and the shoulder 89 is less than the uncompressed axial height of the seal head assembly 60, the spring 62 is compressed axially causing the seal seat 50 contained in the impeller 20 to bear axially against the seal washer 68 of the seal head assembly 60. The bearing seal seat 50 axially deflects the coil spring 62 and the boot 66 of the seal head 60 until the end of the tubular extension 34 of insert 30 passes through housing bore 88 and extends out of the housing 80. The insert 30 is temporarily held in this axially extending position by grasping the tubular extension 34 protruding out of the housing 80. The pump cover 10 is then welded as described earlier to the pump housing 80. After welding the cover to the housing, the tubular extension 34 on the rigid insert 30 is released allowing seal head assembly 60, spring 62, and boot 66 to decompress axially until the ceramic thrust disk 14 mounted in face 22 of the insert 30 is prevented from further axial movement by the axial bias of the graphite phenolic thrust button 13 mounted in the cavity 12 of the cover 10. The thrust button 13 sets a gap 90 between the face 22 and the cover 10 to set the running clearance between the impeller face 22 and the cover 10.

In operation, the motor (not shown) causes the shaft 70 to rotate the elastomeric bladed impeller 30 to pump fluid in and out of the pump 100. As the impeller 30 rotates, it causes the seal seat 50 to rotate by virtue of the positive drive of the flats 38 on the tubular extension 34 engaging the complimentary flats 52 on the inner diameter of the seat seal 50. The mechanical face seal 60 and the axial compression of the spring 62 biases the seal washer 68 toward the front cover 10 and rubs against the seal seat 50. The seal seat 50 is captured in the receiving cavity 36 formed in the rubber body 40. The seal seat 50 is also frictionally engaged by the lip 42 which grips around the outer diameter 56 of the seal seat 50 in the receiving cavity 36 and acts as a secondary rotation drive. In this condition, the elastomeric lip 42 also forms a static seal 48 around the outer diameter 56 of the seal seat 50 to prevent any leakage past the seal seat 50 and out of the housing 80. The seal seat 50 is also forced to move axially towards the front cover 10 and is pressed against the elastomeric sealing shoulder 44 by the fluid pressure in the cavity 86 and cavity 46. The compressed elastomeric material in the shoulder 44 forms a static seal 49 which prevents any fluid being pumped by the impeller 20 from leaking past the seal seat 50, around the tubular extension 34 and out of the housing 80. Optionally, passages (not shown) may be formed in the lip 42 to permit detection of any fluid leakage between the shoulder 44 and the seal ring 50.

While the invention has been described in connection with a preferred embodiment, it will be understood that it is not intended to limit the invention to that embodiment only. On the contrary, it is intended to cover all alternative modifications and equivalents that may be included within the spirit and scope of the invention as defined by the appended claims.

I claim:

1. An elastomeric impeller with a seal seat retainer for a water pump, said impeller seal seat retainer comprising:

a rigid insert having an elastomeric body and a tubular extension, said elastomeric body having a radial elastomeric retaining lip and a portion forming a receiving cavity between said elastomeric lip and said tubular extension; and a seal seat disposed in said receiving cavity, said elastomeric retaining lip being stretched to grip said seal seat in said receiving cavity, said seal seat being positively engaged with said tubular extension to prevent relative rotation therebetween.

2. An impeller as claimed in claim 1 wherein said seal seat having an inner diameter and at least one flat on said inner diameter;

and wherein said tubular extension having an outer diameter and at least one flat on said outer diameter, said flat on said inner diameter engaging said flat on said outer diameter to positively rotate said seal seat with said impeller.

3. An impeller seal seat retainer as claimed in claim 1 wherein said elastomeric body is formed of an elastomer from a group of nitrile and hydrogenated nitrile.

4. An impeller seal seat retainer as claimed in claim 1 wherein said elastomeric retaining lip providing a compressive force on the outer diameter of said seal seat so as to accommodate a wide range of outer diameter tolerances.

5. An impeller seal seat retainer as claimed in claim 1 further comprising:

a static sealing shoulder member between said seal seat and said rigid insert.

6. An impeller seal seat retainer as claimed in claim 2 wherein said at least one flat on said inner diameter is two opposing flats and said at least one flat on said outer diameter is two opposing flats to engage said two opposing flats on said inner diameter.

7. An impeller seal seat retainer as claimed in claim 5 wherein said elastomeric retaining lip having portions forming passageways to permit detection of any leakage between said static sealing shoulder member and said seal seat.

8. A water pump comprising:

a housing with portions forming a cavity;

an elastomeric impeller disposed in said cavity, said impeller having a rigid insert, a tubular extension and an elastomeric body, said elastomeric body having an elastomeric lip, a shoulder and a portion forming a receiving cavity adjacent said elastomeric lip;

a mechanical face seal disposed in said cavity, said mechanical face seal having an inner diameter, said tubular extension disposed in said inner diameter of said mechanical face seal;

a seal seat disposed in said receiving cavity of said impeller, said elastomeric lip being stretched to grip said seal seat in said receiving cavity, said seal seat having an inner diameter, an outer diameter, a first positive rotational drive member on said inner diameter of said seal seat to engage said tubular extension and a second positive rotational drive member engaging said outer diameter of said seal seat; and a cover portion attached to said housing.

9. A water pump as claimed in claim 8 wherein said seal ring having an inner diameter and at least one flat on said inner diameter;

and wherein said tubular extension having an outer diameter and at least one flat on said outer diameter, said flat on said inner diameter engaging said flat on said outer diameter to positively rotate said seal seat with said impeller.

10. A water pump as claimed in claim 8 wherein said elastomeric impeller is formed of an elastomer from a group of nitrile and hydrogenated nitrile.

11. A water pump as claimed in claim 8 wherein said elastomeric retaining lip providing a radially acting compressive force on the outer diameter of said seal seat so as to accommodate a wide range of outer diameter tolerances.

12. A water pump as claimed in claim 8 further comprising a static sealing shoulder member interposed said seal ring and said rigid insert.

13. A water pump as claimed in claim 9 wherein said at least one flat on said inner diameter is two opposing flats and said at least one flat on said outer diameter is two opposing flats to engage said two opposing flats on said inner diameter.

14. A water pump as claimed in claim 12 wherein said elastomeric retaining lip having portions forming passage ways to permit detection of any leakage between said static sealing shoulder member and said seal seat.

15. An impeller for a fluid pump, said impeller comprising:

a rigid insert having a tubular extension, a radially extending portion, an axially extending portion spaced away from said tubular extension and a portion defining a receiving cavity, said tubular extension member having an outer diameter and at least one flat on said outer diameter;

an elastomeric bladed member attached to said axially extending portion;

an elastomeric retaining lip disposed in said receiving cavity and adjacent to said axially extending portion;

an annular seal seat disposed in said receiving cavity, said seal seat having an inner diameter, an outer diameter and at least one flat on said inner diameter engaging said at least one flat on said outer diameter of said tubular extension, said seal seat being retained in said receiving cavity by radially stretching said elastomeric retaining lip about said outer diameter of said seal seat;

an elastomeric shoulder member interposed said seal seat and said radially extending portion of said rigid insert, said elastomeric shoulder member forming a gasket to seal fluid migrating past said lip and said outer diameter of said seal seat.

16. An impeller as claimed in claim 15 wherein said elastomeric bladed member is formed of an elastomer from a group of nitrile and hydrogenated nitrile.

17. An impeller as claimed in claim 15 wherein said elastomeric retaining lip providing a radially acting compressive force on the outer diameter of said seal ring so as to accommodate a wide range of outer diameter tolerances.

18. An impeller as claimed in claim 15 wherein said at least one flat on said inner diameter is two opposing flats and said at least one flat on said outer diameter is two opposing flats to engage said two opposing flats on said inner diameter.

19. An impeller as claimed in claim 15 wherein said elastomeric retaining lip having portions forming passage ways to permit detection of any leakage between said static sealing shoulder member and said seal seat.

20. An impeller as claimed in claim 15 wherein said elastomeric sealing lip forms a gap adjacent said axially extending portion to permit said lip to stretch radially when said seal seat is inserted in said receiving cavity.

* * * * *